US008920621B2

(12) United States Patent
Sugioka

(10) Patent No.: US 8,920,621 B2
(45) Date of Patent: Dec. 30, 2014

(54) PUMP

(75) Inventor: Hideyuki Sugioka, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 246 days.

(21) Appl. No.: 13/491,318

(22) Filed: Jun. 7, 2012

(65) Prior Publication Data

US 2012/0312689 A1 Dec. 13, 2012

(30) Foreign Application Priority Data

Jun. 10, 2011 (JP) ..... 2011-130451

(51) Int. Cl.
*F04B 53/00* (2006.01)
*F04B 19/00* (2006.01)

(52) U.S. Cl.
CPC ..... *F04B 19/006* (2013.01)
USPC ..... 204/600

(58) Field of Classification Search
CPC ..... F04B 19/006; F04B 43/04; F04B 43/043
See application file for complete search history.

(56) References Cited

U.S. PATENT DOCUMENTS 7,081,189 B2 7/2006 Squires
8,303,800 B2 * 11/2012 Fukuda et al. ..... 205/775

FOREIGN PATENT DOCUMENTS

WO WO-2009031375 A1 * 3/2009 ..... G01N 37/00

OTHER PUBLICATIONS

M.Z.Bazant and T.M.Squires, Induced-Charge Electrokinetic Phenomena: Theory and Microfluidic Application, Physical Review Letters, vol. 92,No. 6 , The American Physical Society 066101-066101-4 (2004).
Dmitri Lastochki, et al., "Electrokinetic Micropump and Micromixer Design Based on AC Faradaic Polarization", Journal of Applied Physics, vol. 96, No. 3, Aug. 1, 2004.
Jeremy A. Levitan, et al., "Fast AC Electro-Osmotic Micropumps With Nonplanar Electrodes", Applied Physics Letters 89, 143508 (2006).

* cited by examiner

*Primary Examiner* — Alex Noguerola
(74) *Attorney, Agent, or Firm* — Canon USA IP Division

(57) ABSTRACT

A pump includes a flow passage through which a liquid containing an electrolytic solution is conveyed, a pair of electrodes in the flow passage to apply an electric field along the direction in which the liquid is conveyed, and a conductive member connected to one of the pair of electrodes and in contact with the liquid in the flow passage. The conductive member includes a sidewall portion that locally divides a flow of the liquid in the flow passage. The conductive member connected to one of the pair of electrodes may be a polyhedron or a column that is convex toward the electrode to which the conductive member is not connected.

10 Claims, 7 Drawing Sheets

UP TO (L/2)w

UP TO 2Lh

UP TO 2NLh

PUMP

BACKGROUND OF THE INVENTION

1. Field of the Invention

The present disclosure relates to a pump, and specifically to a micro pump that uses electro-osmosis and that can be applied to micro-total analysis system (μ-TAS), fluid integrated circuit (fluid IC), and so forth.

2. Description of the Related Art

Micro pumps that use electro-osmosis are advantageous in being relatively simple in structure, being easily mountable into micro flow passages, and so forth. Therefore, the micro pumps are used in fields such as μ-TAS, Lab-on-a-chip, and fluid IC.

Under such circumstances, micro pumps that use induced-charge electro-osmosis (ICEO) have been drawing attention in recent years, because such micro pumps increases the flow rate of a liquid, can be driven on an AC voltage to suppress a chemical reaction occurring between an electrode and the liquid, and so forth.

U.S. Pat. No. 7,081,189 (hereinafter referred to as "Patent Document 1") and M. Z. Bazant and T. M. Squires, Phys. Rev. Lett. 92, 066101 (2004) (hereinafter referred to as "Non-Patent Document 1") disclose pumps that use induced-charge electro-osmosis and that are configured as described in (1) or (2) below:

(1) a pump in which a half of a metal post placed between electrodes is coated with a dielectric thin film to control a region in which an electric charge is induced in the metal post by an electric field to control a liquid flow (an ICEO pump with a half-coated metal post); and (2) a pump in which a metal post having an asymmetric shape such as a triangular shape is disposed between electrodes to control a liquid flow to a constant direction (an ICEO pump with an asymmetric metal post).

Applied Physics Letters 89, 143508 (2006) (hereinafter referred to as "Non-Patent Document 2") discloses an AC-driven electro-osmosis pump (ACEO pump) in which rectangular electrodes with different electrode areas are provided opposite to each other in the direction in which a fluid flows through a flow passage and in which an AC voltage is applied between the rectangular electrodes to generate a pumping action. The AC-driven electro-osmosis pump is formed as a three-dimensional (3D) ACEO pump in which the rectangular electrodes are partially provided with a three-dimensionally stepped structure to improve the pumping performance.

Journal Applied Physics 96, 1730 (2004) (hereinafter referred to as "Non-Patent Document 3") discloses a micro pump (planar-orthogonal micro-pump) which utilizes an electrokinetic phenomenon and in which a pair of linear thin-film electrodes are disposed perpendicularly to each other so as not to intersect each other.

The pumps which utilize electro-osmosis according to Patent Document 1 and Non-Patent Documents 1 to 3 are expected for their future utilization, but may not be able to demonstrate their full pumping performance if the flow passage is long, because the pump generates a relatively low pressure per unit area in the flow passage occupied by the pump. Increasing the length of the pump to enhance the generated pressure may increase the proportion of the area in the fluid integrated circuit occupied by the pump to increase the size and cost of the entire system.

Currently, pumps with a large size that require an external pressure generation source are generally used. If alternative pumps with a small size and a simple structure that do not require an external pressure source or the like can be provided, however, such pumps may drastically reduce the size and cost of the entire system, and may significantly widen the range of use of fluid integrated circuits.

If pumps with a small size and a simple structure that can demonstrate its full pumping performance even in the case where the flow passage is long can be provided, such pumps may achieve a fluid integrated circuit that not only allows control of a local flow but also allows integrated dynamic control of a macroscopic flow including liquid delivery in the entire fluid apparatus such as μ-TAS.

Patent Document 1 and Non-Patent Document 1 describes a fluid device that utilizes a sidewall flow due to an induced-charge electro-osmosis phenomenon of a conductive post disposed between electrodes. However, one end of the conductive post is not connected to the electrodes, and therefore a forward flow and a backward flow may be produced along the flow passage at the same time, which may reduce the pumping performance.

Non-Patent Document 2 describes a pump which utilizes ACEO and in which rectangular electrodes are partially provided with a three-dimensionally stepped structure. However, the pump is the same as ACEO pumps according to the related art in that it utilizes a flow on the top surface of the three-dimensionally stepped electrodes, and Non-Patent Document 2 does not describe or suggest utilizing a sidewall flow.

Non-Patent Document 3 describes a micro pump in which a pair of linear thin-film electrodes are disposed perpendicularly to each other so as not to intersect each other. However, the micro pump utilizes an electrokinetic phenomenon on the top surface of the thin-film electrodes, and Non-Patent Document 3 does not describe or suggest utilizing a sidewall flow.

SUMMARY OF THE INVENTION

The present disclosure has been made in view of such background art, and provides a pump with a small size and a simple structure that generates a high pressure per unit area in a flow passage occupied by the pump.

In order to address the foregoing issues, the present disclosure provides a first pump including a flow passage through which a liquid containing an electrolytic solution is conveyed, a pair of electrodes in the flow passage to apply an electric field along a direction in which the liquid is conveyed, and a conductive member connected to one of the pair of electrodes and in contact with the liquid in the flow passage, in which the conductive member includes a sidewall portion that locally divides a flow of the liquid in the flow passage.

In order to address the foregoing issues, the present disclosure also provides a second pump including a flow passage through which a liquid containing an electrolytic solution is conveyed, a plurality of electrodes including a plurality of pairs of electrodes in the flow passage to apply an electric field along a direction in which the liquid is conveyed, and a plurality of conductive members connected to an electrode, of the plurality of electrodes, other than the electrode that is first encountered in the direction in which the liquid is conveyed to be in contact with the liquid in the flow passage, in which the plurality of conductive members include a sidewall portion that locally divides a flow of the liquid in the flow passage.

Thus, a pump with a small size and a simple structure that generates a high pressure per unit area in a flow passage occupied by the pump can be provided.

Further features of the present disclosure will become apparent from the following description of exemplary embodiments with reference to the attached drawings.

DESCRIPTION OF THE EMBODIMENTS

Embodiments will be described in detail below.

A first pump according to the present disclosure includes a flow passage through which a liquid containing an electrolytic solution is conveyed, a pair of electrodes provided in the flow passage to apply an electric field along the direction in which the liquid is conveyed, and a conductive member connected to one of the pair of electrodes to be in contact with the liquid in the flow passage. The conductive member includes a sidewall portion that locally divides a flow of the liquid in the flow passage.

Figure 1:
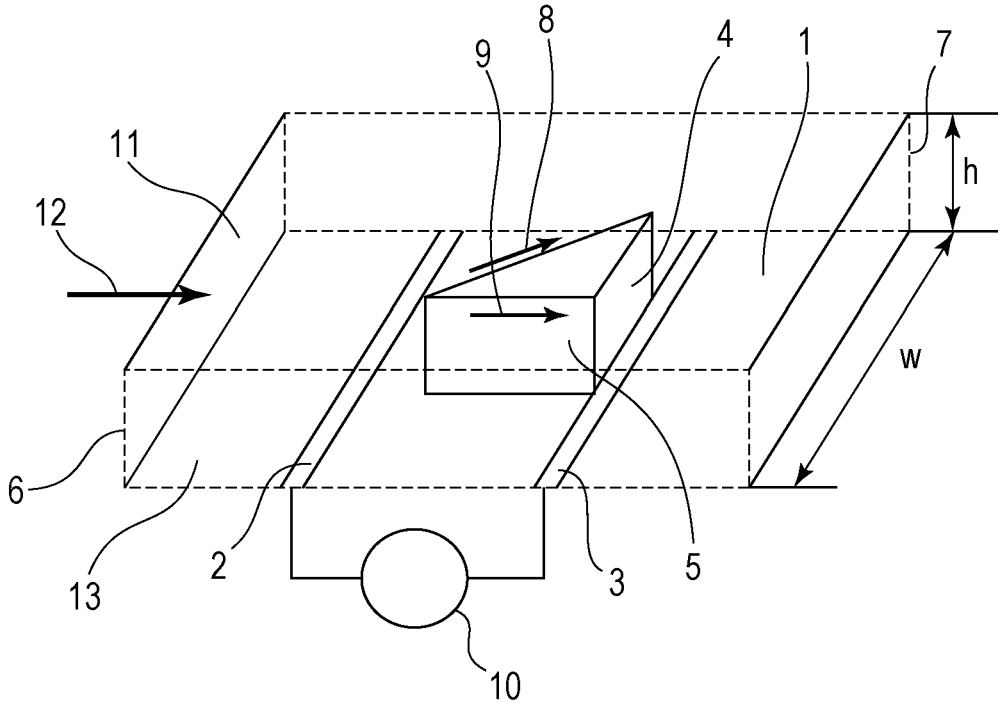
FIG. 1 is a schematic diagram showing a pump according to an embodiment.

The pump according to the present disclosure will be described below with reference to the drawings. FIG. 1 is a schematic diagram showing a pump according to an embodiment disclosed herein.

In FIG. 1, reference numeral 1 denotes a flow passage through which a liquid containing an electrolytic solution is conveyed, 2 and 3 denote a pair of electrodes that apply to the liquid an electric field having a component along the direction in which the liquid is conveyed, 4 denotes a conductive member connected to one electrode 3 of the pair of electrodes to be in contact with the liquid in the flow passage, 5 denotes a sidewall portion of the conductive member 4 that locally divides a flow of the liquid in the flow passage 1. Reference numerals 6 and 7 denote sidewalls of the flow passage, 8 and 9 denote sidewall flows, and 10 denotes a voltage applying unit that applies a voltage to the pair of electrodes 2 and 3. Reference numeral 11 denotes a liquid, 12 denotes the direction in which the liquid is conveyed, and 13 denotes the bottom surface of the flow passage.

The pump shown in FIG. 1 includes a flow passage 1 through which a liquid 11 containing an electrolytic solution is conveyed, a pair of electrodes 2 and 3 provided in the flow passage 1 to apply an electric field along the direction 12 in which the liquid is conveyed, and a conductive member 4 connected to one electrode 3 of the pair of electrodes to be in contact with the liquid in the flow passage. The conductive member 4 includes a sidewall portion 5 that locally divides a flow of the liquid in the flow passage.

In the pump, sidewall flows due to an electrokinetic phenomenon are generated on the sidewall portion of the conductive member by applying a desired voltage between the pair of electrodes. Accordingly, a pump with a small size and a simple structure that generates a high pressure per unit area occupied by the pump can be provided.

Figure 2:
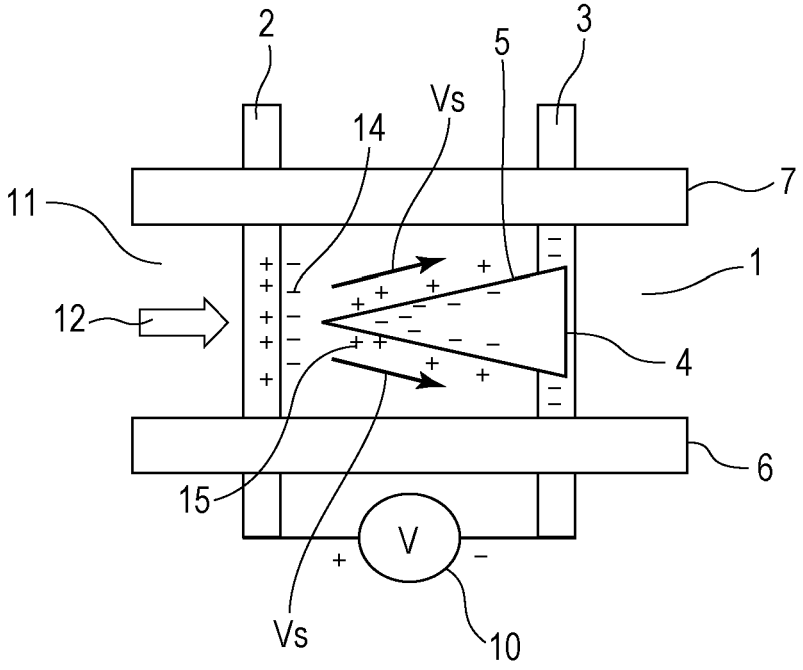
FIG. 2 illustrates how the pump conveys a liquid.

FIG. 2 illustrates how the pump conveys a liquid. In FIG. 2, reference symbol Vs denotes a slip velocity on the electrode surface generated by the sidewall portion 5 by applying a voltage. In the pump of FIG. 1, an electric field is generated in the flow passage 1 when a voltage $V_0$ is applied between the pair of electrodes 2 and 3. As a result of the electric field, negative ions 14 gather on the positive electrode 2 side and positive ions 15 gather on the negative electrode 3 side so that a so-called electric double layer is formed in the vicinity of the electrodes 2 and 3. The ions forming the electric double layer generate the slip velocity Vs on the surface as a result of the electric field along the electrode surface. The slip velocity has a net value Vs also for an alternating voltage, and the net slip velocity Vs produces the sidewall flows 8 and 9 derived from an electrokinetic phenomenon on the sidewall portion 5 which locally divides a flow of the liquid in the flow passage 1.

In the pump, the sidewall flows 8 and 9 derived from an electrokinetic phenomenon are produced on the sidewall portion 5 which locally divides a flow of the liquid in the flow passage 1 by applying a desired voltage to the pair of electrodes 2 and 3 which apply to the liquid an electric field having a component along the direction in which the liquid is conveyed. Accordingly, a pump with a small size and a simple structure that generates a high pressure per unit area occupied by the pump can be provided. That is, the present disclosure provides a pump with a small size and a simple structure that generates a high pressure per unit area occupied by the pump.

The voltage applying unit 10 may be a battery, an alternating-current power source, a direct-current power source, a pulse voltage source, an arbitrary-waveform voltage source, or the like. In order to suppress generation of bubbles due to an electrochemical reaction or the like, however, a power source that generates an alternating voltage at a frequency of 30 Hz or higher is preferably used. In order to charge the electric double layer with an electric charge, meanwhile, an alternating voltage at a frequency of 100 kHz or lower is desirably used. In order to generate an AC electro-osmosis (ACEO) flow or an ICEO flow, in addition, the average field intensity $E_0$ ($=V_0/d$) determined on the basis of the applied voltage $V_0$ and the distance d between the electrodes is $0.1\times10^4$ V/m to $100.0\times10^4$ V/m, preferably $0.5\times10^4$ V/m to $5\times10^4$ V/m.

The electrodes 2 and 3 are formed from a conductive material that induces an electric charge upon application of an electric field. Examples of such a conductive material include metals (for example, gold and platinum), carbon, and carbonaceous materials. Gold, platinum, and carbon materials which are stable toward the liquid to be conveyed are particularly preferably used. While a chemically stable conductive material (such as gold, platinum, and carbon) is preferably used to be in contact with the liquid surface, metals such as Ta, Ti, Cu, Ag, Cr, and Ni may also be used.

In order to efficiently generate a vortex flow, a plurality of pairs of electrodes 2 and 3 may be provided in the flow passage. The number of pairs of electrodes 2 and 3 may be selected in consideration of the width of the flow passage, the size of the conductive member, the viscosity of the liquid to be conveyed, and so forth.

The pair of electrodes 2 and 3 may be shaped in any way as long as they do not obstruct a flow along the flow passage. For example, the pair of electrodes 2 and 3 may have a bulk shape such as that of a spacer, be a structure made of a porous material with a large number of pores, or has a filmy, linear, mesh, or annular shape. Preferably, one or both of the pair of electrodes are a linear electrode, a mesh electrode, or an annular electrode. That is, the electrodes allow passage of the liquid in the flow passage in the direction in which the liquid flows in the flow passage. The electrodes may be long or short in length along the flow passage, and a plurality of independent pairs of electrodes may be disposed along the flow passage.

The conductive member connected to one of the pair of electrodes to be in contact with the liquid may be a desired column such as a triangular column, a polygonal column, an elliptical column, or a part of an elliptical column, or may be a desired polyhedron such as a sphere or an elliptical sphere. The conductive member connected to one of the pair of electrodes is preferably a polyhedron or a column that is convex toward the electrode to which the conductive member is not connected. A plurality of conductive members may be connected to one of the pair of electrodes.

Preferably, the pair of electrodes are thin-film planar electrodes disposed on the bottom surface of the flow passage, the conductive member connected to one of the pair of electrodes is a thick-film columnar conductive member with a columnar structure having the sidewall portion, and the thin-film planar electrodes are smaller in thickness than the thick-film columnar conductive member.

Preferably, in addition, the pair of electrodes are each a linear electrode disposed on the bottom surface of the flow passage, and the conductive member connected to one of the pair of electrodes is a polyhedron.

The flow passage through which the liquid is conveyed may be formed from a material commonly used in fields such as μ-TAS. Specifically, the flow passage may be formed from a material that is stable toward the liquid to be conveyed. Examples of such a material include inorganic materials such as $SiO_2$ and Si and polymer resins such as fluorine resins, polyimide resins, and epoxy resins.

In order to mix a fluid containing bio-related particles, the width of the flow passage is preferably about 10 μm to 1 mm, but may be 1 to 2000 μm as necessary.

From the viewpoint of increasing the flow rate, the depth of the flow passage is preferably larger than the width of the flow passage. Specifically, the ratio of the depth to the width of the flow passage is 0.1 or more, preferably 0.2 or more, more preferably 0.5 or more.

The liquid that can be conveyed in the flow passage basically contains polar molecules containing electrically charged components. Examples of the liquid include water and solutions containing various electrolytes. The liquid may also be a liquid containing fine bubbles contained in an electrolytic solution such as water, oil and fat materials, or the like, or a liquid containing inorganic or organic fine particles or colloidal particles.

In order to prepare the pump, the flow passage may be prepared using micro-electromechanical systems (MEMS) technology commonly used to prepare a fluid conveying apparatus that uses a micro flow passage such as so-called μ-TAS, lithography technology, or the like. The flow passage may also be prepared by machining, bonding, pressing, or the like.

A second embodiment includes a flow passage through which a liquid containing an electrolytic solution is conveyed, a plurality of electrodes including a plurality of pairs of electrodes provided in the flow passage to apply an electric field along the direction in which the liquid is conveyed, and a plurality of conductive members connected to an electrode, of the plurality of electrodes, other than the electrode that is first encountered in the direction in which the liquid is conveyed to be in contact with the liquid in the flow passage. The plurality of conductive members include a sidewall portion that locally divides a flow of the liquid in the flow passage.

Preferably, a plurality of conductive members are provided for each of the plurality of electrodes.

Preferably, conductive members, of the plurality of conductive members, connected to electrodes, of the plurality of electrodes, in odd-numbered rows and conductive members, of the plurality of conductive members, connected to electrodes, of the plurality of electrodes, in even-numbered rows are disposed in a staggered arrangement with respect to each other, and an alternating voltage is applied between each pair of electrodes in the odd-numbered row and the even-numbered row.

[Embodiments]

In the following description, the same members in the drawings are denoted by the same reference numeral to omit repeated description.

(First Embodiment)

The embodiment uses the pump shown in FIG. 1. In FIG. 1, the pair of electrodes 2 and 3 which apply to the liquid 11 an electric field having a component along the direction in which the liquid is conveyed are thin-film planar electrodes disposed on the bottom surface 13 of the flow passage. The conductive member 4 connected to one electrode 3 of the pair of electrodes to be in contact with the liquid is a thick-film columnar conductive member with a columnar structure. The thin-film planar electrode is smaller in thickness than the thick-film columnar conductive member. The thick-film columnar conductive member substantially has the sidewall portion 5.

Since the thin-film planar electrode 2 is smaller in thickness than the thick-film columnar conductive member 4, and the thick-film columnar conductive member has the sidewall portion 5, sidewall flows in one direction can be effectively generated without obstructing a flow of the liquid in the direction of the flow passage. The width of the thin-film electrode 2 facing the conductive member 4 is preferably smaller than the width of the conductive member 4 in the direction of the flow, which effectively prevents generation of a backward flow. In addition, the width of the thin-film electrode 2 is preferably smaller than the width of the electrode 3, which also effectively prevents generation of a backward flow.

In the pump of FIG. 1, as shown in FIG. 2, in the case where the left electrode 2 has a positive potential and the right electrode 3 has a negative potential, positive ions 15 gather around the negative electrode 3, negative ions 14 gather around the positive electrode 2, and a slip velocity Vs is generated on the sidewall portion by a component of an electric field E along the electrode surface. When the voltage is inverted, the slip velocity Vs in the same direction is generated. Therefore, sidewall flows 8 and 9, which are slip flows, in the same direction as those for a direct voltage can be generated also for an alternating voltage. An alternating voltage is preferably used because utilization of an alternating voltage has the effect to suppress generation of bubbles derived from an electrochemical reaction.

Such flows due to movement of ions forming an electric double layer formed to block an induced electric charge generated on the electrode surface are known as induced-charge electro-osmosis (ICEO) or AC electro-osmosis (ACEO). In the first embodiment, the voltage applying unit is an alternating voltage source, and the pump generates slip flows on the sidewall portion using AC electro-osmosis (ACEO) or induced-charge electro-osmosis (ICEO), effectively suppressing generation of bubbles or the like.

Around the electrode 2, slipping in the direction opposite to the sidewall flows 8 and 9 may be generated. However, slipping in the opposite direction generated at the bottom of the flow passage is significantly suppressed in flow rate on the interface, and therefore is not likely to contribute to a macroscopic flow. Therefore, such slipping is ignorable compared to the effect of slipping on the sidewall surfaces of the three-dimensional conductive member 4 including slipping at the center of the flow passage, and a macroscopic net flow in the direction 12 in which the liquid is conveyed can be generated. As discussed earlier, if the width of the thin-film electrode 2 facing the conductive member 4 is smaller than the width of the conductive member 4 in the direction of the flow and the width of the electrode 3, generation of a backward flow can be effectively prevented. The direction of the slip flows may be opposite under the influence of the state of the surfaces, a delay in response of the ions, a faradic current, or the like.

Figure 3A:
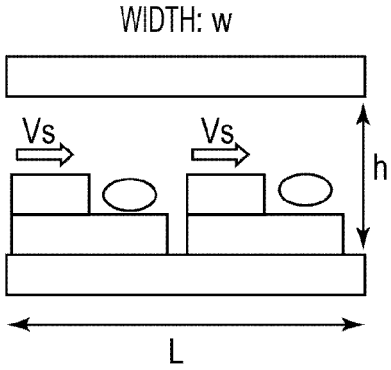
FIGS. 3A to 3C illustrate differences between a pump according to the related art and the pump.
Figure 3B:
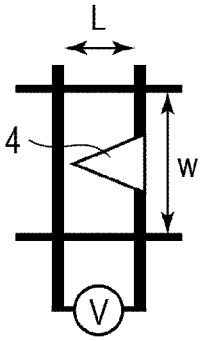
Figure 3C:
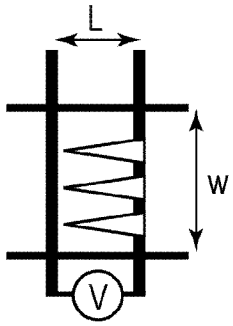

FIGS. 3A to 3C illustrate differences between a three-dimensional (3D) ACEO pump according to the related art and the pump. The largest area that activates the slip velocity and that can be provided in a flow passage of width w, height h, and length L is considered. As shown in FIG. 3A, the 3D ACEO pump according to the related art can activate an area of about (L/2)w. Meanwhile, the pump according to the present disclosure can turn an area of about 2Lh into a slip activating surface in the case where a single conductive member 4 is provided (N=1) as shown in FIG. 3B, and can turn an area of about 2NLh into a slip activating surface in the case where N conductive members 4 are provided. That is, a pump with a small size and a simple structure that generates a high pressure per unit area occupied by the pump and that provides a large slip activating surface can be provided particularly when (L/2)w is less than 2NLh, in other words, the height h is larger than w/4N.

When the average width and the height of the flow passage are w and h, respectively, in FIG. 1, the average flow rate Up achieved by the pump, when less than the representative slip velocity Uc ($\approx\epsilon LE_0^2/\mu$), is defined as $Up\approx(R_0/R)\beta(NMLh/Lw)\epsilon LE_0^2/\mu=(R_0/R)\beta MNUch/w$. In the formula, N is the average number of devices in the direction of the width of the flow passage, M is the number of devices in the direction of the flow, $\epsilon$ is the permittivity of the fluid (in case of water, $\epsilon\approx80\,\epsilon_0$, where $\epsilon_0$ is vacuum permittivity), $\mu$ is the viscosity of the fluid, $E_0=V_0/L$ is the average electric field applied, $V_0$ is the voltage applied between the electrodes 2 and 3 (in case of an AC voltage, the effective value of the voltage), and L is the gap distance between the electrodes 2 and 3. $\beta$ is a parameter indicating the performance of a single device, and varies in accordance with the electrode interface, the applied voltage, the representative size of the system, and so forth and has a magnitude of about 0.001 to 1. Occasionally, the direction of the net flow provided by the pump becomes opposite to the direction based on the standard theory, and the sign of $\beta$ becomes negative. R is the flow resistance of the entire flow circuit, and $R_0$ is the flow resistance for a single device. When $\Delta P$ indicates the generated pressure, Up is equal to $\Delta P/R$. Hence, the generated pressure $\Delta P$ is defined as $\Delta P\approx R(R_0/R)\beta NM(h/w)\epsilon LE_0^2/\mu$. In addition, the area A of the device section is equal to MLw, and thus the generated pressure per unit device area is defined as $\Delta P/MLw\approx(1/Lw)R_0\beta N(h/w)\epsilon LE_0^2/\mu$.

It is assumed as follows: w=100 μm, h=100 μm, $\epsilon\approx80\,\epsilon_0$, μ=1 mPa·s, and L≈50 μm. Then, by applying voltages of $V_0$=1.0, 1.5, 2.0, and 3.0 V, there are respectively obtained electric fields of $E_0$=10, 15, 20, and 30 kV/m, average flow rates of $Up\approx3.5\ MN(h/w)(R_0/R)\beta$, $8\ MN(h/w)(R_0/R)\beta$, $14\ MN(h/w)(R_0/R)\beta$, and $32\ MN(h/w)(R_0/R)\beta$ mm/s, and generated pressures of $\Delta P\approx3.5\ MN(h/w)\beta R_0$, $8\ MN(h/w)\beta R_0$, $14\ MN(h/w)\beta R_0$, and $32\ MN(h/w)\beta R_0$ mPa.

More specifically, a single device with $\beta\approx1$, M=N=1, h/w=1, and $R_0\approx1$ kPa/m provides average flow rates of Up≈3.5, 8, 14, and 32 mm/s and generated pressures of $\Delta P\approx3.5$, 8, 14, and 32 Pa, respectively, at voltages of $V_0$=1.0, 1.5, 2.0, and 3.0 V for a short flow passage of about 0.2 mm that meets $R_0/R=1$. For a long flow passage of about 2 cm that meets $R_0/R=1/100$, however, the device provides the same generated pressures, but provides reduced average flow rates of Up≈0.0035, 0.008, 0.014, and 0.032 mm/s. The area A (=Lw) of the device section is 0.02 $mm^2$. That is, the generated pressures per unit area are defined as $\Delta P/A\approx175$, 400, 700, and 1600 $Pa/(mm)^2$.

Multistage devices, in which the number of devices in the direction of the flow is multiplied by M, are preferably used because the average flow rate Up and the generated pressure $\Delta P$ are multiplied by M. However, the area A of the device section is also multiplied by M, and thus the generated pressure per unit area is not varied. Likewise, the ACEO pump according to the related art may also be multistaged with a view to increasing the generated pressure. However, the generated pressure per unit area may not be increased, and such a configuration is not advantageous in integrating fluid devices.

In contrast, by utilizing the sidewall flows 8 and 9 on the sidewall portion 5 of the conductive member 4 connected to one electrode 3 of the pair of electrodes, the generated pressure and the average flow rate are multiplied by N, without increasing the device area A, by multiplying the number of devices in the direction of the width of the flow passage by N, which has the effect to multiply the generated pressure per unit area by N. That is, a pump with a small size and a simple structure that generates a high pressure per unit area occupied by the pump and that provides a large slip activating surface can be provided.

Figure 4A:
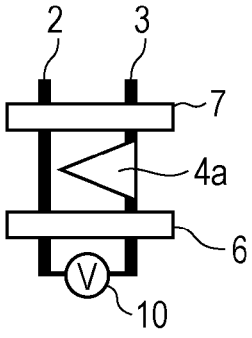
FIGS. 4A to 4F are each a schematic diagram showing a pump according to another embodiment.
Figure 4B:
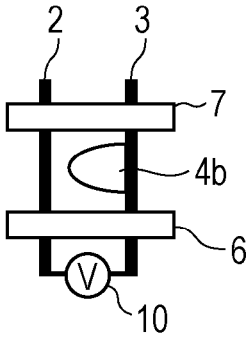
Figure 4C:
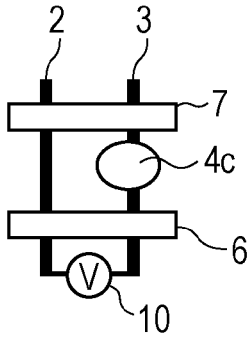
Figure 4D:
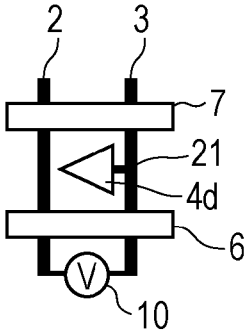
Figure 4E:
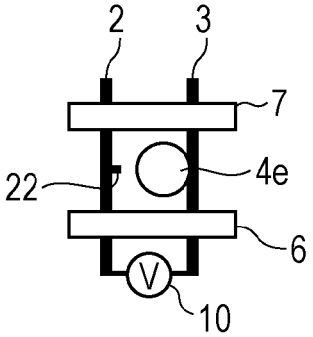

FIGS. 4A to 4F are each a schematic diagram showing a pump according to another embodiment. FIGS. 4A to 4F are each a schematic diagram showing a flow passage seen from above. The conductive member 4 connected to one electrode 3 of the pair of electrodes 2 and 3 may be formed as a desired polygonal column such as a triangular column, a semi-elliptical column, or a circular column as shown in FIGS. 4A, 4B, and 4C, respectively. The connection of the conductive member 4 to one electrode 3 of the pair of electrodes may be achieved by stacking the conductive member on the strip-like planar thin-film electrode 3, or by connecting the conductive member 4 via a strip-like planar thin-film electrode for connection, denoted by 21 in FIG. 4D, connected to the strip-like planar thin-film electrode so as to form a T-shape. In addition, the electrode 2 facing the conductive member 4 via a gap may be formed in any way, and may be formed as a T-shaped planar thin-film electrode as shown in FIG. 4E, for example. In FIGS. 4A to 4E, the conductive member 4 connected to one electrode 3 of the pair of electrodes to be in contact with the liquid is a polyhedron that is convex toward the other electrode 2, which achieves the effect to effectively generate a slip velocity on the sidewall portion.

Figure 4F:
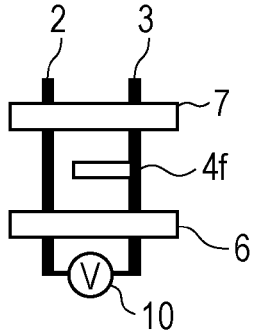
Figure 5A:
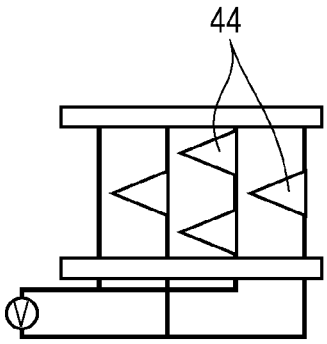
FIGS. 5A to 5F are each a schematic diagram showing a pump according to a second embodiment.
Figure 5B:
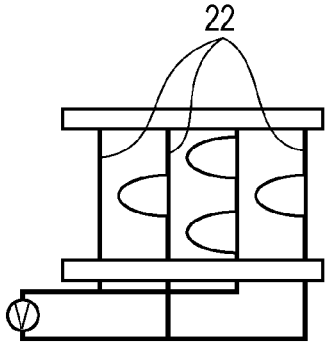
Figure 5C:
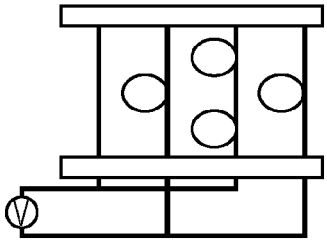
Figure 5D:
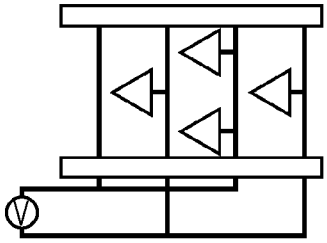
Figure 5E:
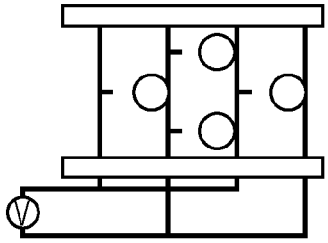
Figure 5F:
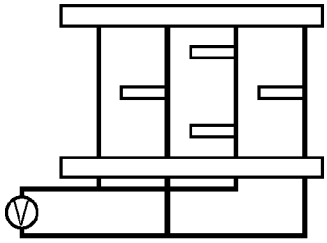

The columnar structure forming the conductive member 4 may be a thin and tall wall-like conductive structure such as that indicated by 4*f* in FIG. 4F. Such a columnar conductive structure with a narrow width in the direction of the flow passage is suitable for increasing the number (N) of conductive members 4 as discussed above, and has the effect to increase the generated pressure per unit area.

(Second Embodiment)

FIGS. 5A to 5F are each a schematic diagram showing a pump according to a second embodiment.

The pump according to the embodiment includes a plurality of electrodes 22 that apply to the liquid an electric field having a component along the direction in which the liquid is conveyed, and a plurality of conductive members 44 connected to the electrodes to be in contact with the liquid. Conductive members, of the plurality of conductive members, connected to electrodes, of the plurality of electrodes, in odd-numbered rows and conductive members, of the plurality of conductive members, connected to electrodes, of the plurality of electrodes, in even-numbered rows are disposed in a staggered arrangement with respect to each other, and an alternating voltage is applied between electrodes in the odd-numbered row and the even-numbered row.

With the conductive members connected to the electrodes in the odd-numbered rows and the conductive members connected to the electrodes in the even-numbered rows disposed in a staggered arrangement with respect to each other and with an alternating voltage applied between the electrodes in the odd-numbered row and the even-numbered row as shown in FIGS. 5A to 5F, it is possible to increase the rate of integration and to increase the generated pressure per unit area.

(Third Embodiment)

FIGS. 6A to 6D are each a schematic diagram showing a pump according to a third embodiment.

Figure 6A:
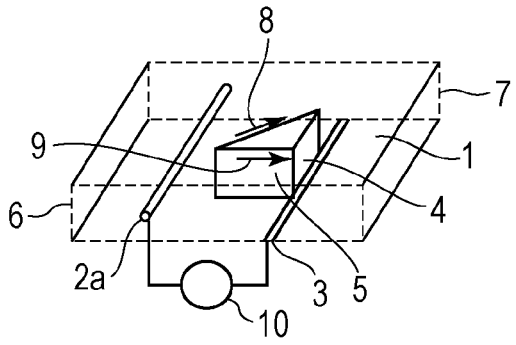
FIGS. 6A to 6D are each a schematic diagram showing a pump according to a third embodiment.
Figure 6B:
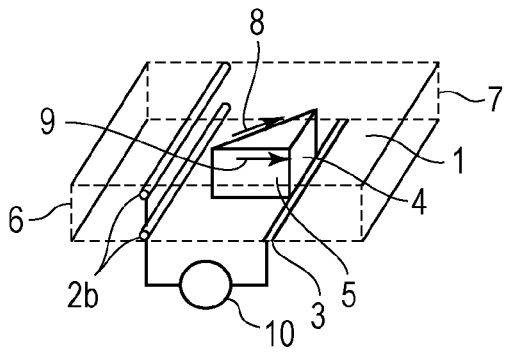
Figure 6C:
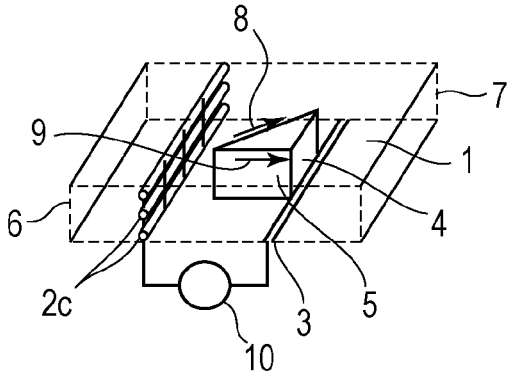
Figure 6D:
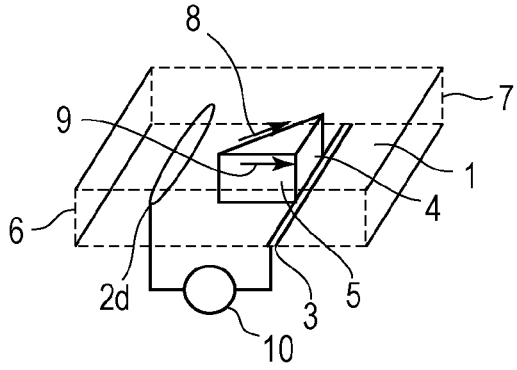

In the pump according to the embodiment, one or both of the pair of electrodes that apply to the liquid an electric field having a component along the direction in which the liquid is conveyed are a linear electrode [2*a* and 2*b* in FIGS. 6A and 6B], a mesh electrode [2*c* in FIG. 6C], or an annular electrode [2*d* in FIG. 6D].

In FIG. 6, with one or both of the pair of electrodes that apply an electric field being a linear electrode, a mesh electrode, or an annular electrode, the electrodes allow passage of the liquid in the direction of the flow. That is, an electric field in the direction of the flow can be effectively applied without significantly increasing the flow resistance $R_0$ of the device. Application of an AC voltage achieves the same effect as that obtained by the first and second embodiments.

(Fourth Embodiment)

Figure 7:
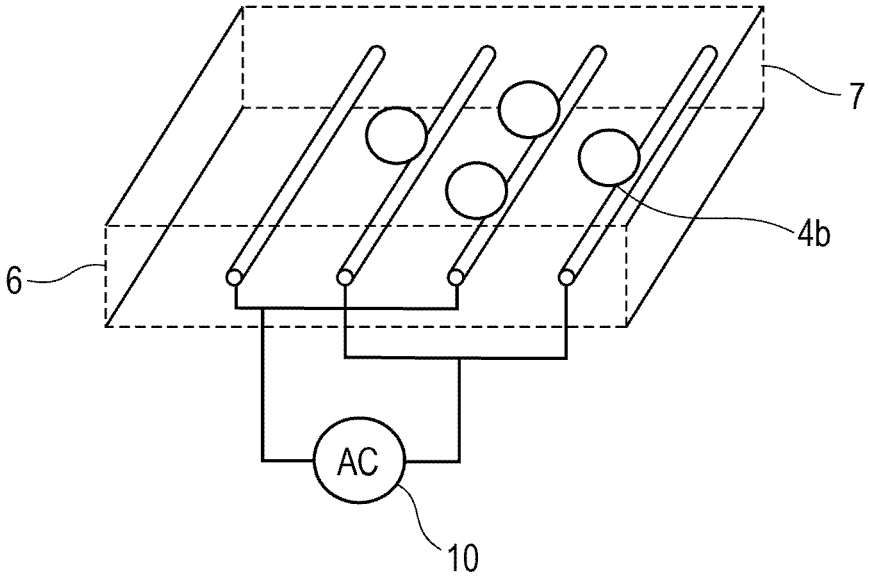
FIG. 7 is a schematic diagram showing a pump according to a fourth embodiment.

FIG. 7 is a schematic diagram showing a pump according to a fourth embodiment.

In the pump according to the fourth embodiment, conductive structures connected to one of the pair of electrodes 2 and 3 are each a desired conductive polyhedron such as a sphere or an elliptical sphere. That is, in the fourth embodiment, the pair of electrodes that apply to the liquid in the flow passage an electric field having a component along the direction in which the liquid is conveyed are each a linear electrode disposed in the middle between the bottom surface and the top surface of the flow passage, and the conductive members connected to the electrodes to be in contact with the liquid are each a conductive polyhedron. Use of the sidewall flows on the conductive polyhedrons forming the conductive members has the effect to further increase the slip activating area. Application of an AC voltage achieves the same effect as that obtained by the first to third embodiments. The devices according to the fourth embodiment including a pair of electrodes 2 and 3 and a conductive polyhedron as a basic unit can be not only disposed repeatedly two-dimensionally as shown in the drawing but also stacked three-dimensionally in the height direction, which advantageously drastically increases the slip activating area per unit area.

(Fifth Embodiment)

Figure 8:
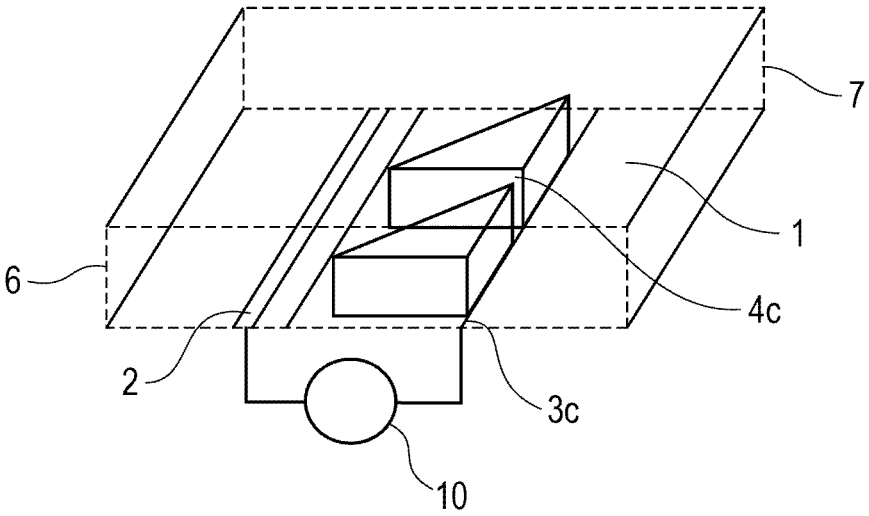
FIG. 8 is a schematic diagram showing a pump according to a fifth embodiment.

FIG. 8 is a schematic diagram showing a pump according to a fifth embodiment.

In the pump according to the fifth embodiment, the pair of electrodes 2 and 3 are asymmetric planar electrodes with different areas, and columnar conductive members 4*c* providing substantial sidewall flows are disposed on the side of a wider electrode 3*c* of the asymmetric electrodes. That is, the embodiment provides a pumping action derived from asymmetric activating surfaces according to the related art in addition to a pumping action due to the sidewall flows according to the present disclosure.

The pump has a small size and a simple structure and generates a high pressure per unit area in a flow passage occupied by the pump, and thus can be utilized in μ-TAS, Lab-on-a-chip, fluid IC, and so forth.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-130451 filed Jun. 10, 2011, which is hereby incorporated by reference herein in its entirety.

What is claimed is:

1. A pump comprising:

a flow passage through which a liquid is conveyed;

a pair of electrodes in the flow passage to apply an electric field along a direction in which the liquid is conveyed;

a conductive member connected to one of the pair of electrodes and in contact with the liquid in the flow passage; and an alternating voltage applying unit connected to the electrodes, wherein the conductive member includes a sidewall portion that locally divides a flow of the liquid in the flow passage.

2. The pump according to claim 1, wherein the pair of electrodes are planar electrodes disposed on a bottom surface of the flow passage.

3. The pump according to claim 1, wherein the conductive member connected to the one of the pair of electrodes is a polyhedron or a column that is convex toward the electrode to which the conductive member is not connected.

4. The pump according to claim 3, wherein the pair of electrodes are each a linear electrode disposed on the bottom surface of the flow passage, and the conductive member connected to the one of the pair of electrodes is a polyhedron.

5. The pump according to claim 1, wherein one or both of the pair of electrodes are a linear electrode, a mesh electrode, or an annular electrode.

6. The pump according to claim 1, wherein a plurality of conductive members are connected to one of the pair of electrodes.

7. The pump according to claim 1, the pair of electrodes are asymmetric planar electrodes with different area.

8. A pump comprising:

a flow passage through which a liquid is conveyed;

a plurality electrodes including a plurality of pairs of electrodes in the flow passage to apply an electric field along a direction in which the liquid is conveyed; and a plurality of conductive members connected to an electrode, of the plurality of electrodes, other than the electrode that is first encountered in the direction in which the liquid is conveyed to be in contact with the liquid in the flow and an alternating voltage applying unit connected to the plurality electrodes, wherein the plurality of conductive members include a sidewall portion that locally divides a flow of the liquid in the flow passage.

9. The pump according to claim 8, wherein a plurality of conductive members are provided for each of the plurality of electrodes.

10. The pump according to claim 8, wherein conductive members, of the plurality of conductive members, connected to electrodes, of the plurality of electrodes, in odd-numbered rows and conductive members, of the plurality of conductive members, connected to electrodes, of the plurality of electrodes, in even-numbered rows are disposed in a staggered arrangement with respect to each other, and an alternating voltage is applied between each pair of electrodes in the odd-numbered row and the even-numbered row.

* * * * *